US008651070B2

(12) United States Patent
Lindner et al.

(10) Patent No.: US 8,651,070 B2
(45) Date of Patent: Feb. 18, 2014

(54) METHOD AND APPARATUS TO CONTROL COOLANT FLOW THROUGH AN ENGINE, ESPECIALLY FOR A MOTOR VEHICLE

(75) Inventors: Bjoern Gerd Lindner, Schiltach (DE); Barbara Ruhland-Lindner, legal representative, Schiltach (DE); Vincent Ursini, Clinton Township, MI (US)

(73) Assignee: Behr America, Inc., Troy, MI (US)

( * ) Notice: Subject to any disclaimer, the term of this patent is extended or adjusted under 35 U.S.C. 154(b) by 0 days.

(21) Appl. No.: 13/544,629

(22) Filed: Jul. 9, 2012

(65) Prior Publication Data

US 2014/0007825 A1 Jan. 9, 2014

(51) Int. Cl.
*F01P 5/10* (2006.01)

(52) U.S. Cl.
USPC ..... 123/41.44; 123/41.02

(58) Field of Classification Search
CPC ..... F01P 7/081; F01P 7/084; F01P 5/10; F01P 5/12
USPC ..... 123/41.02, 41.08–41.1, 41.44, 198 C
See application file for complete search history.

(56) References Cited

U.S. PATENT DOCUMENTS

| | | | | |
|---|---|---|---|---|
| 5,095,855 | A * | 3/1992 | Fukuda et al. | 123/41.44 |
| 2002/0096132 | A1 * | 7/2002 | Stretch et al. | 123/41.12 |
| 2007/0234980 | A1 * | 10/2007 | Namuduri et al. | 123/41.44 |

FOREIGN PATENT DOCUMENTS

| | | | | |
|---|---|---|---|---|
| JP | 58187515 A | * | 11/1983 | F01P 7/14 |

* cited by examiner

*Primary Examiner* — Hung Q Nguyen
(74) *Attorney, Agent, or Firm* — Muncy, Geissler, Olds & Lowe, PLLC

(57) ABSTRACT

A method to control coolant flow through an engine, especially for a motor vehicle, wherein the coolant is heated by the engine and cooled by a radiator and the coolant flow depends on the number of rotations of the engine. To prevents cavitations and high pressures on heat exchangers and to allow an optimal coolant flow, a magnetic field for controlling magneto rheological fluid to regulate the coolant flow is used.

8 Claims, 3 Drawing Sheets

METHOD AND APPARATUS TO CONTROL COOLANT FLOW THROUGH AN ENGINE, ESPECIALLY FOR A MOTOR VEHICLE

BACKGROUND OF THE INVENTION

1. Field of the Invention

The invention refers to a method and an apparatus to control coolant flow through an engine, especially for a motor vehicle. The method comprises a coolant heated by the engine and cooled by a radiator wherein coolant flow depends on the number of rotations of the engine. The apparatus has an engine connected to a radiator, a coolant pump arranged near the engine and combined with the radiator and a component forming a coolant circuit wherein a coolant fluid leaves the radiator in direction to the engine, exits the engine and flows through the coolant pump to the radiator.

2. Description of the Background Art

FIG. 2 shows a coolant circuit for an engine used in a vehicle today. A main cooling circuit leads a fluid coolant between the engine 1 and a main radiator 12. A coolant pump 13 moves the fluid coolant which is cooled by the main radiator 12 to the engine 1. Into the engine 1 the fluid coolant absorbs engine heat. The heated fluid coolant is conducted from the engine 1 through a thermostat 14 back to the main radiator 12. A secondary cooling circuit is consisted by a low temperature radiator 15 and a charge-air cooler 16 wherein the heated air left the engine 1 is conducted through the charge-air cooler 16 back to the engine 1. In the charge-air cooler 16 the engine air is cooled by a gaseous coolant which is moved by an electrical pump 17 from the low temperature radiator 15 to the charge-air cooler 16. In the charge-air cooler 16 the gaseous coolant absorbs the heat from the engine air wherein the engine air is cooled. The cooled engine air is conducted back to the engine while the gaseous coolant goes back to the low temperature radiator 15 for cooling.

FIG. 3 shows a schematic diagram of another heat exchanger. A coolant pump 2 is arranged at the engine 1. The fluid coolant left the coolant pump 2 is conducted through the thermostat 3 to the radiator 4. After the coolant is circulated in the radiator 4 it flows back to the engine 1. In another direction heated engine air leaves engine 1 in direction of a heater core 5. Heater core 5 emits heat to a vehicle cabin wherein engine air is cooled down and flows back to the engine 1.

In coolant circuits of motor vehicles coolant pumps are operating depending on engine number of rotations. The coolant pumps running all the time are changing the flow rate of coolant with changing engine number of rotations. During the warm up operation of the engine the coolant flow prolongs the warm up operation. At high engine numbers of rotations the coolant flow is very high. Those coolant flows are often in the saturation for heat exchange and running at high speeds which can lead to cavitations and high pressures on heat exchangers as radiators or heater cores and hoses.

SUMMARY OF THE INVENTION

It is therefore an object of the present invention to provide a method and an apparatus to control coolant flow through an engine, especially for a motor vehicle, which prevent cavitations and high pressures on heat exchangers and allow an optimal coolant flow.

In an embodiment, a magnetic field for controlling a magneto rheological fluid to regulate the coolant flow is used. By utilizing a magneto rheological fluid full controllability of coolant flow can be achieved because magnetic rheological fluid changes its viscosity depending on strength of magnetic field. This leads to better fuel economy and reduces exhaust emissions. The coolant flow is adapted to current operation conditions of the engine. The flow rate is reduced at high engine number of rotations to avoid pressure peaks and keep flow rates at optimum level for heat exchanger. Saturations and possible cavitations are avoided.

In addition, a high magnetic field to the magneto rheological fluid is applied to generate no or low coolant flow. On this way less exhaust emissions and lower fuel consumption are realized during the accordant engine operation.

Furthermore, the high magnetic field is applied during the warm up operation of the engine. Hence, the duration of the warm up operation is reduced and engine achieves its optimal temperature very promptly.

In another aspect of the invention, no or low magnetic field is applied to generate a high coolant flow. Optimal heat exchange is realized.

Moreover, no or low magnetic field is applied during operation of warm engine. During operation of a warm engine coolant flow rate operates for optimal heat exchange. For a better fuel economy parasitic torque load on engine are reduced. The controlled flow rate is used to assist system temperature control.

In a further aspect of the invention, an apparatus to control coolant flow through an engine, especially for a motor vehicle, comprises an engine connected to a radiator, a coolant pump arranged near the engine and combined with the radiator and means forming a coolant circuit wherein a fluid coolant leaves the radiator in direction to the engine, exits the engine and flows through the coolant pump to the radiator. An apparatus which prevents cavitations and high pressures on heat exchangers and allows an optimal coolant flow has a magnetic unit containing a magnetic rheological fluid in the coolant circuit. When magneto rheological fluid is subjected to a magnetic field, the magneto rheological fluid greatly increases its apparent viscosity until to a point of becoming a viscoelastic solid. According to the strength of magnetic field the coolant flow can be controlled. This leads to better fuel economy and reduces exhaust emissions. The coolant flow is adapted to current operation conditions of the engine.

In addition, the magnetic unit is arranged near the coolant pump. More constant coolant flows can be realized independent of engine number of rotations. Pressure peaks can be avoided and a better durability of engine is warranted.

Furthermore, the magnetic unit is formed as a part of the cooling pump. Hence, the assembling of the coolant circuit is simplified and costs are reduced.

In a further aspect of the invention, an apparatus to control coolant flow through an engine, especially for a motor vehicle, comprises an engine connected to a radiator, a coolant pump arranged near the engine and combined with the radiator and means forming a coolant circuit wherein a fluid coolant leaves the radiator in direction to the engine, exits the engine and flows through the coolant pump to the radiator. An apparatus which prevents cavitations and high pressures on heat exchangers and allows an optimal coolant flow has a separate electric water pump in a coolant circuit. With help of this separate electric pump the coolant flow is controlled independent to the engine number of rotations wherein more constant coolant flows can be adjusted. The flow rate is reduced at high engine numbers of rotations to avoid pressure peaks and keep flow rates at optimum level for heat exchanger. Saturations and possible cavitations are avoided. For a better fuel economy parasitic torque loads on engine are reduced. The controlled flow rate is used to assist system temperature control. This functions could be achieved with speed controlled electric water pump with additional function of high flow rates in idle or with non operating engine 1.

Moreover, the separate electric water pump is arranged near the coolant pump. The separate electric water pump is part of the coolant circuit and can control no or low coolant flow to accelerate warm up operation of engine. Alternatively, the separate electric water pump can adjust a constant coolant flow during operation of warm engine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
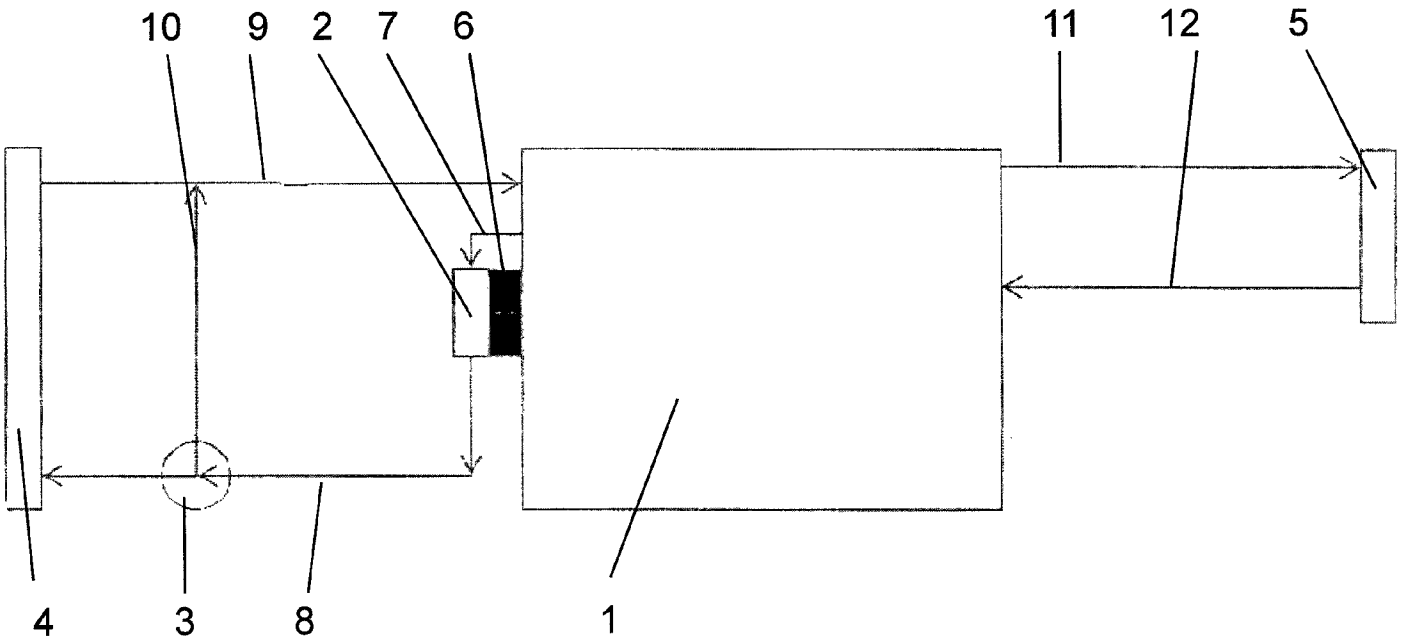
FIG. 1 illustrates a first embodiment of an apparatus for controlling coolant flow according to the invention.
Figure 2:
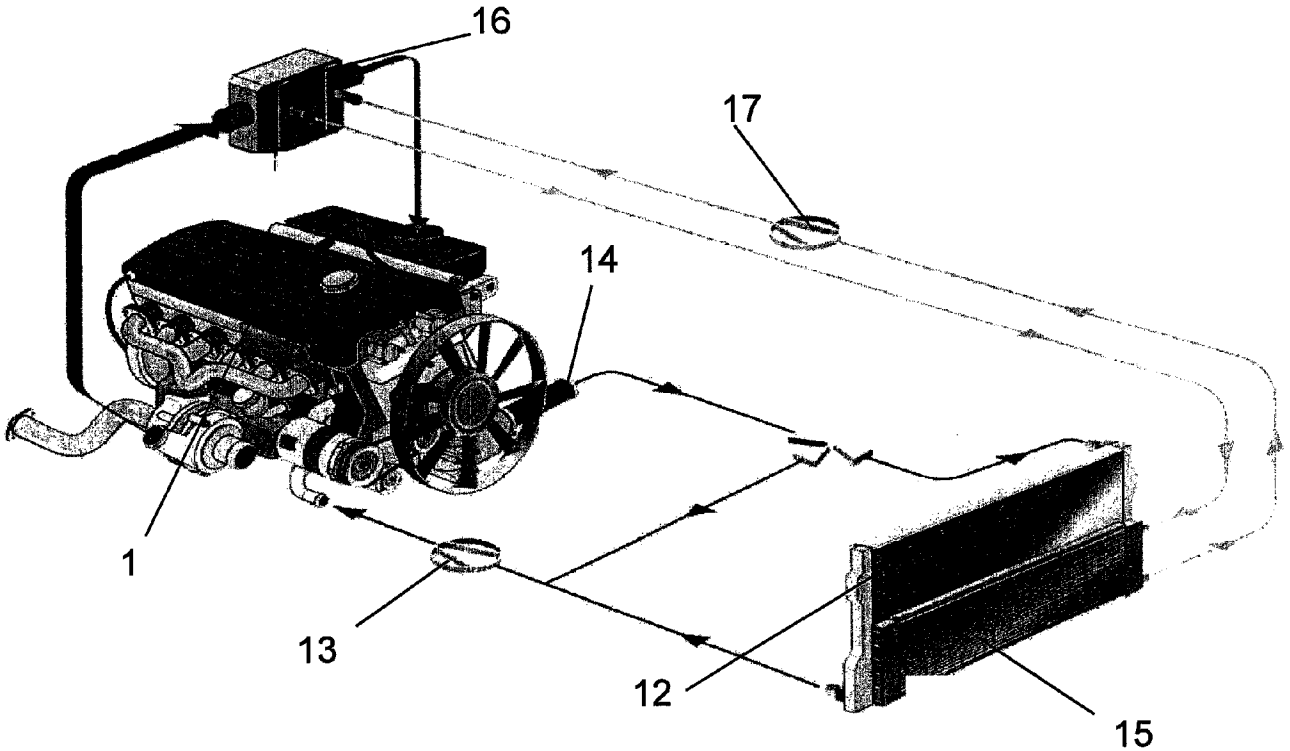
Fig. 2 (CONVENTIONAL ART)
FIG. 2 illustrates a first embodiment of heat exchanger according to the conventional art.
Figure 3:
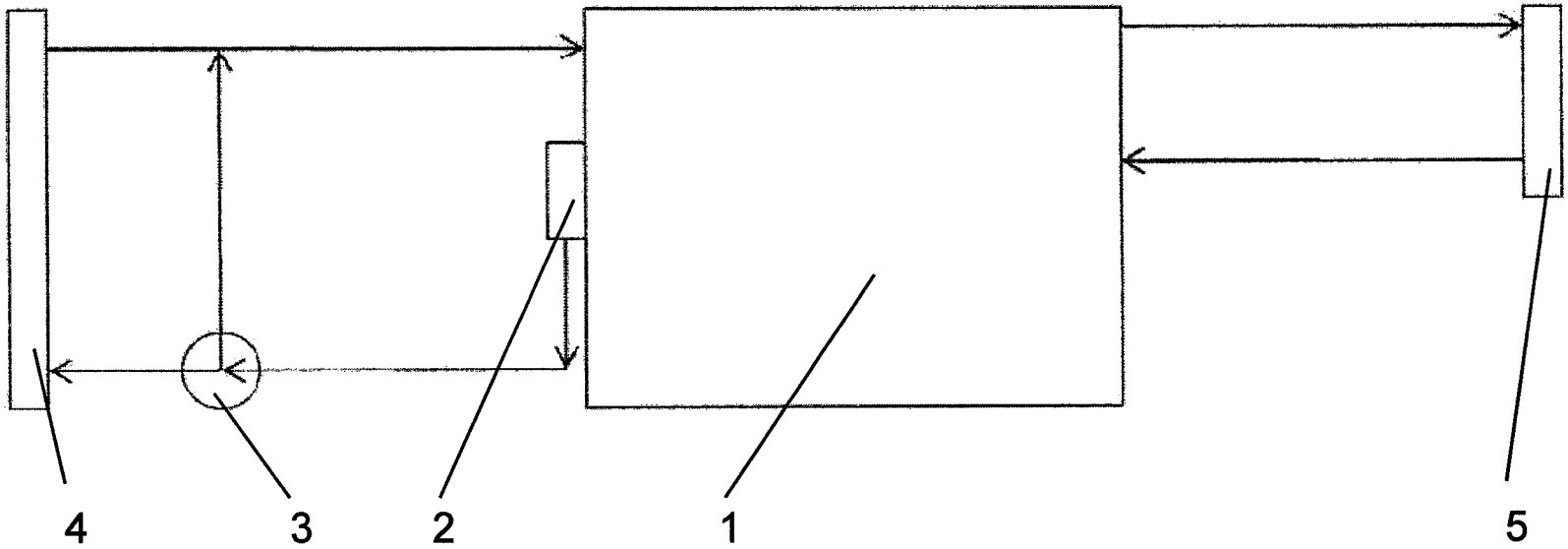
Fig. 3 (CONVENTIONAL ART)
FIG. 3 illustrates a schematic diagram of heat exchanger according to the conventional art.

FIG. 1 shows a first embodiment of an apparatus for controlling coolant flow according the invention. A combustion engine 1 is connected with a coolant pump 2 by a conduit 7. The coolant pump 2 is combined to a radiator 4 over the conduit 8. In this conduit 8 a thermostat 3 is fitted between coolant pump 2 and radiator 4. A further conduit 9 connects the radiator 4 with the engine 1. These features form a first coolant circuit. The cooled coolant in form of a fluid flows from the radiator 4 to engine 1 where the coolant absorbs the engine heat wherein the heated coolant flows back to radiator 4 for cooling.

On the other side of the engine 1 a secondary coolant circuit is formed by connecting a heater core 5 with the engine 1 over a conduit 11 in the direction from engine 1 to heater core 5 and a conduit 12 in direction from the heater core 5 to engine 1. In this secondary coolant circuit a heated engine air flows to the heater core 5. The heater core 5 emits heat to a vehicle cabin. The cold engine air leaves the heater core 5 and flows back to the engine 1.

The coolant pump 2 carries a magnetic unit 6 or an electric water pump, which is arranged at the engine 1. Magnetic unit 6 and separate electric water pump execute the same tasks. In the following the magnetic unit 6 shall be considered. The magnetic unit 6 is filled with a magneto rheological fluid. Such a magneto rheological fluid has the property to change its viscosity depending on a magnetic field. Importantly, the yield stress of the magneto rheological fluid when in its active state can be controlled very accurately by varying the magnetic field intensity. This feature is used to control the coolant flow through the first coolant circuit.

By cold engine 1 the magnetic unit 6 generates high magnetic field to reduce the coolant flow through the coolant pump 2 and the radiator 4. Following, no or low coolant flow moves through the first coolant circuit and the warm up operation of engine 1 is accelerated.

During operation of warm engine 1 the magnetic field generated in magnet unit 6 is low. Consequently, an approximately constant coolant flow can be adjusted for optimal heat exchange. For a better fuel economy parasitic torque loads on engine 1 are reduced. The controlled flow rate is used to assist system temperature control.

Using magneto rheological fluid coolant flow rates can be controlled from minimum to maximum, wherein the flow depends on engine speed and opened or closed thermostat 3. By controlling the coolant flow exhaust emissions of engine are reduced and a better fuel economy is realized because lower fuel consumption. Furthermore, extreme high flow pressures can be limited which aides in fuel economy and temperature control of the system.

The coolant flow rates can achieve quicker response to an engine characteristic depends on variable coolant temperature between 90 and 125° C. The number of rotation signals of engine 1 can be used for control algorithm.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method to control coolant flow through an engine of a motor vehicle, the method comprising:

heating the coolant by the engine;

cooling the coolant by a radiator, wherein the coolant flow is based on the number of rotations of the engine;

using a magnetic field for controlling magneto rheological fluid to regulate the coolant flow, and applying a high magnetic field to the magneto rheological fluid to generate no or low coolant flow.

2. The method according to claim 1, further comprising the step of: applying the high magnetic field during a warm up operation of the engine.

3. The method according to claim 1, further comprising the step of: applying no or low magnetic field to generate a high coolant flow.

4. The method according to claim 3, further comprising the step of: applying no or low magnetic field during operation of warm engine.

5. The method according to claim 1, further comprising:

pumping the coolant via a coolant pump, the coolant pump being arranged near the engine and combined with the radiator.

6. An apparatus to control coolant flow through an engine of a motor vehicle, the apparatus comprising:

the engine connected to a radiator;

a coolant pump arranged near the engine and combined with the radiator;

a component forming a coolant circuit, wherein a fluid coolant leaves the radiator in a direction to the engine, exits the engine and flows through the coolant pump to the radiator; and a magnetic unit containing a magnetic rheological fluid in the coolant circuit, wherein a high magnetic field is applied to the magnetic rheological fluid to generate no or low coolant flow.

7. The apparatus according to claim 6, wherein the magnetic unit is arranged near the coolant pump.

8. The apparatus according to claim 7, wherein the magnetic unit is formed as part of the coolant pump.

* * * * *